United States Patent [19]

Matalia et al.

[11] 4,407,196

[45] Oct. 4, 1983

[54] METHOD OF ENHANCING INKING IN OFFSET PRESSES

[75] Inventors: Harshad D. Matalia, Easton, Pa.; Menashe Navi, New York, N.Y.

[73] Assignee: American Newspaper Publishers Association, Easton, Pa.

[21] Appl. No.: 361,276

[22] Filed: Mar. 24, 1982

Related U.S. Application Data

[63] Continuation-in-part of Ser. No. 125,827, Feb. 29, 1980, abandoned.

[51] Int. Cl.[3] ..... B41F 7/12; B41F 7/30; B41F 31/06; B41F 7/36

[52] U.S. Cl. ..... 101/142; 101/148; 101/229; 101/363

[58] Field of Search ..... 101/350, 363, 364, 207, 101/208, 209, 210, 148, 142, 147, 143, 365, 351, 352, 170, 229

[56] References Cited

U.S. PATENT DOCUMENTS

| | | | |
|---|---|---|---|
| 1,807,921 | 6/1931 | Lang et al. . | |
| 2,240,762 | 5/1941 | Dietrich | 101/350 |
| 2,256,514 | 9/1941 | Brueshaber | 101/350 |
| 2,276,662 | 3/1942 | Matuschke | 101/363 |
| 2,310,788 | 2/1943 | Hummelchen | 101/350 |
| 2,376,620 | 5/1945 | Piazze . | |
| 2,578,921 | 12/1951 | Cramer | 101/350 |
| 2,678,001 | 5/1954 | Davidson, Jr. | 101/147 |
| 2,711,132 | 6/1955 | Viscardi . | |
| 2,891,471 | 6/1959 | Sengewald | 101/157 |
| 3,036,927 | 5/1962 | Jerothe | 101/170 X |
| 3,180,257 | 4/1965 | Shields | 101/154 |
| 3,585,932 | 6/1971 | Granger | 101/350 |
| 3,587,463 | 6/1971 | Granger | 101/366 X |
| 3,613,578 | 10/1971 | Heurich | 101/350 |
| 3,630,146 | 12/1971 | Shields | 101/351 |
| 3,645,202 | 2/1972 | Laki | 101/148 |
| 3,818,830 | 6/1974 | Schultz | 101/350 |
| 3,835,597 | 9/1974 | Wasil | 101/348 X |
| 3,926,114 | 12/1975 | Matuschke | 101/148 |
| 4,009,658 | 3/1977 | Heurich | 101/348 |
| 4,016,811 | 4/1977 | Zavodny | 101/148 |
| 4,026,210 | 5/1977 | Merzagora | 101/350 |
| 4,152,986 | 5/1979 | Dadowski | 101/170 X |
| 4,158,333 | 6/1979 | Navi | 101/363 |
| 4,237,785 | 12/1980 | Dahlgren | 101/148 X |

FOREIGN PATENT DOCUMENTS

| | | | |
|---|---|---|---|
| 564593 | 7/1930 | Fed. Rep. of Germany | 101/147 |
| 501924 | 3/1939 | United Kingdom | 101/350 |

*Primary Examiner*—J. Reed Fisher

*Attorney, Agent, or Firm*—David H. Semmes; Warren E. Olsen

[57] ABSTRACT

Offset, rotary newspaper printing press systems, particularly a method of enhancing inking of the plate cylinder. The method includes defining a plurality of ink repository cells within the surface of an inking cylinder, immersing the repository cells within an ink reservoir, scraping excess ink from the surface of the inking cylinder and rotating the inking cylinder and ink-filled cells against the surfaces of a pair of form rollers, contacting the plate cylinder. Modifications of invention include rotating the watering cylinders against one of the form rollers of the pair or rotating the watering cylinder against a form cylinder which independently controls the plate cylinder.

1 Claim, 8 Drawing Figures

RETROFITTED DRY OFFSET INKING SYSTEM

METHOD OF ENHANCING INKING IN OFFSET PRESSES

CROSS REFERENCE TO RELATED APPLICATIONS

This application is a continuation-in-part of application Ser. No. 125,827, filed Feb. 29, 1980, now abandoned.

The present application is based upon METHOD OF ENHANCING INKING IN ROTARY OFFSET PRESSES (Ser. No. 125,827), filed Feb. 29, 1980 and includes additional disclosure with respect to operating characterisitcs and press operating parameters, as illustrated in FIGS. 2, 3 and 4.

BACKGROUND OF THE INVENTION

1. Field of the Invention

Rotary newspaper printing press offset inking systems, particularly an ink feed station providing precise ink flow adjustment with a minimum of mechanical parts, eliminating, for example, rollers, oscillators and the like. Conventionally, ink is metered from an engraved roller by either one or more of the following:

(1) The flexographic system, which uses a rubber covered roller to squeeze excess ink off the engraved roller and which is ineffective with high viscosity printing inks where the ink layer thickness becomes a function of press speed.

(2) The gravure system where a doctor blade is applied to the plate cylinder in a positive angle manner. This system is effective only with very low viscosity type ink.

The present system can be retrofitted in conventional offset printing units with minimum alterations. Its primary advantage is uniform ink and water flow distribution across the web, while eliminating the conventional plurality of inking rollers or the necessity for an oscillator. In the dry offset mode, a single engraved or "Anilox" inking roller supplies and maintains a fresh ink film of uniform thickness. In other modes, separate "Anilox" rollers are used for ink and water.

Since many inking rollers are eliminated, there is a reduction in "spray", and a reduction in workroom noise level, as well as a reduction in energy required to drive the press. These benefits contribute materially to enhancing the working environment under present OHSA standards.

The method is simple and economical and is admirably suited to retrofitting in an existing offset unit.

A Listing of the Prior Art

| | |
|---|---|
| LANG | 1,807,921 |
| DIETRICH | 2,240,762 |
| HUMMELCHEN | 2,310,788 |
| PIAZZE | 2,376,620 |
| VISCARDI | 2,711,132 |
| SENGEWALD | 2,891,471 |
| SHIELDS | 3,180,527 |
| GRANGER | 3,585,932 |
| HURICH | 3,613,578 |
| SHIELDS | 3,630,146 |
| MERZAGORA | 4,026,210 |

These references were discussed in an accompanying Prior Art Statement, filed in the application papers.

SUMMARY OF THE INVENTION

Conventional inking systems for offset presses may include eight to ten inking rollers. In a preferred mode, the present system has two engraved rollers. The first engraved roller applies ink to a pair of form rollers contacting the plate cylinder and a second engraved roller may apply water to a third form roller, independently contacting the plate cylinder.

According to the present method, each engraved inking and water roller is provided with a plurality of repository cells engraved in its cylindrical surface. As the inking roller is immersed in the ink reservoir, ink is retained in the repository cells. A reverse angle doctor blade is used to scrape excess ink from the cylindrical surface prior to contact of the repository cells with the form rollers, then re-immersing of the engraved cells within the ink reservoir.

After being scraped by the doctor blade, the engraved roller contains a specified quantity of ink which is a function of repository cell configuration. The cells may be variously configured to provide more or less ink to the plate cylinder. Thus, ink is delivered uniformly across the press and transferred only to the contacting segments of the plate cylinder. There are no mechanical adjustments to be made, since the density level of the finished product is a function of both ink type and engraved repository cell configuration. Once these parameters are determined, there is no need to adjust the ink settings on the press.

DESCRIPTION OF THE PREFERRED EMBODIMENTS

Figure 1:
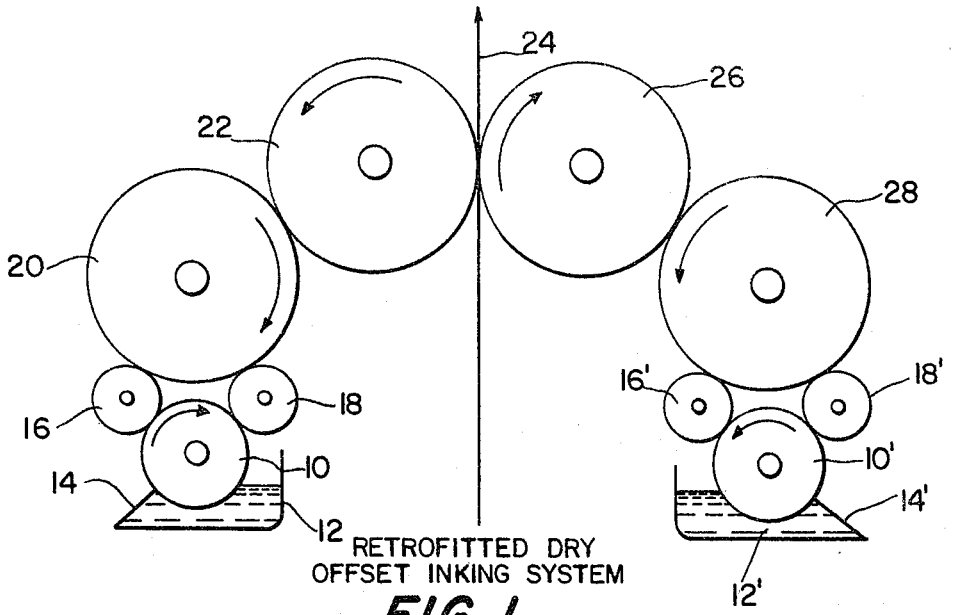
FIG. 1 is a schematic of a retrofited "dry" offset inking system, showing a single inking roller contacting two form rollers, as the relief plate cylinder contacts the blanket or impression cylinder.

In FIG. 1 there is illustrated a conventional dry offset system which may be used together with photopolymer plates on a offset type newspaper press. Engraved surface inking roller 10, after collecting ink in the ink reservoir 12, is scraped by reverse angle doctor blade 14 before contact of friction driven rubber form rollers 16 and 18, which in turn deposit ink on the surface of plate cylinder 20. Plate cylinder 20 contacts impression or blanket cylinder 22 which contacts web 24. A similar ink system is used for cylinders 26 and 28, utilizing ink reservoir 12', doctor blade 14', engraved roller 10' and form rollers 16' and 18'.

Figure 2:
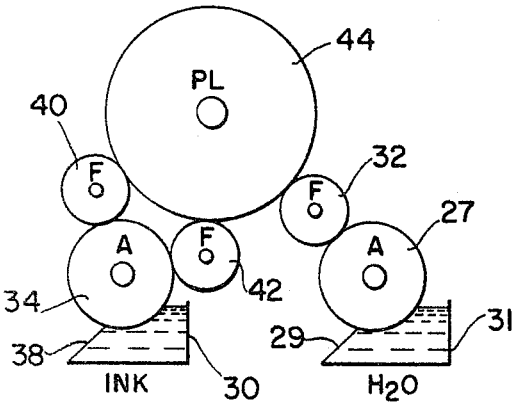
FIG. 2 is a schematic of an offset inking system according to the present invention and embodying two form rollers contacted by the Anilox inking cylinder and a single form roller contacted by the Anilox water cylinder.

In FIG. 2 there is illustrated the present method applied to an offset printing system wherein engraved or Anilox inking cylinder is rotatably positioned within ink reservoir 30, so as to be scraped clean by doctor blade 38, prior to contacting dual form rollers 40 and 42 which engage plate cylinder 44. A separate Anilox water cylinder 27 may be employed to distribute water via independent form roller 32 after contacting reservoir 31 and being scraped clean by doctor blade 29. A fresh ink film of uniform thickness is transferred thusly to the plate cylinder.

Figure 5:
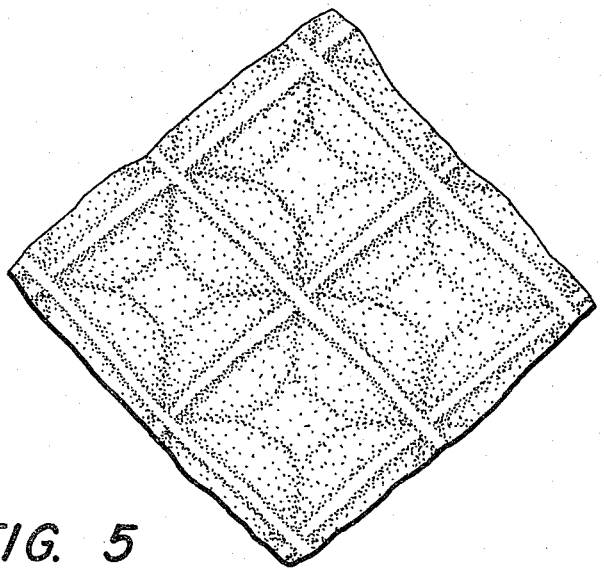
FIG. 5 is an enlarged photolithograph of the engraved inking cylinder surface, showing the truncated pyramid configuration of the ink cells, aligned so as to be parallel with the axis of rotation of the inking cylinder.
Figure 6:
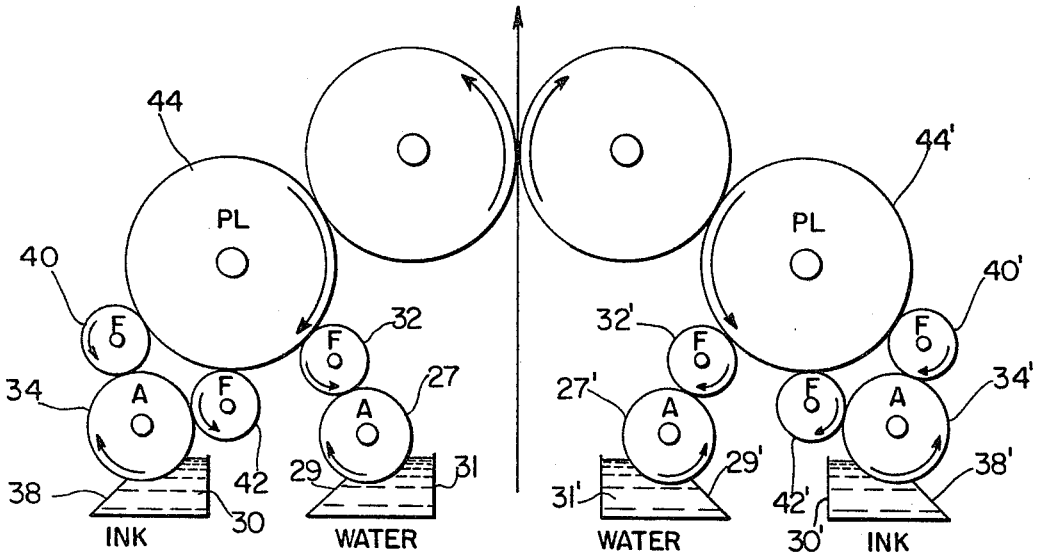
FIG. 6 is a schematic of an offset inking system, modified or "retrofited" according to FIG. 2.
Figure 7:
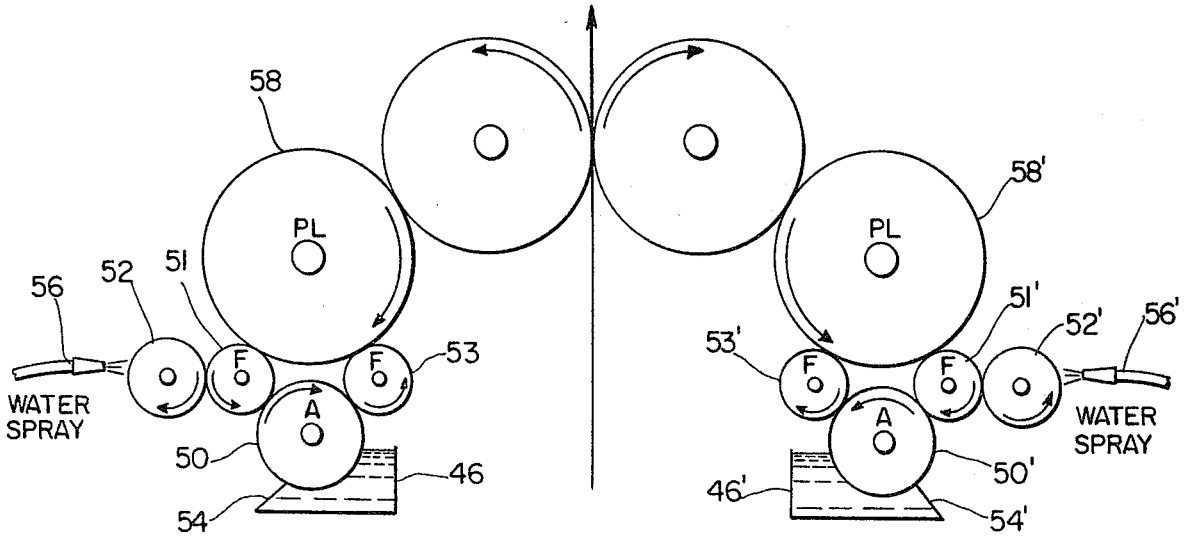
FIG. 7 is a schematic of an offset inking system modified or "retrofited" according to FIG. 3.
Figure 8:
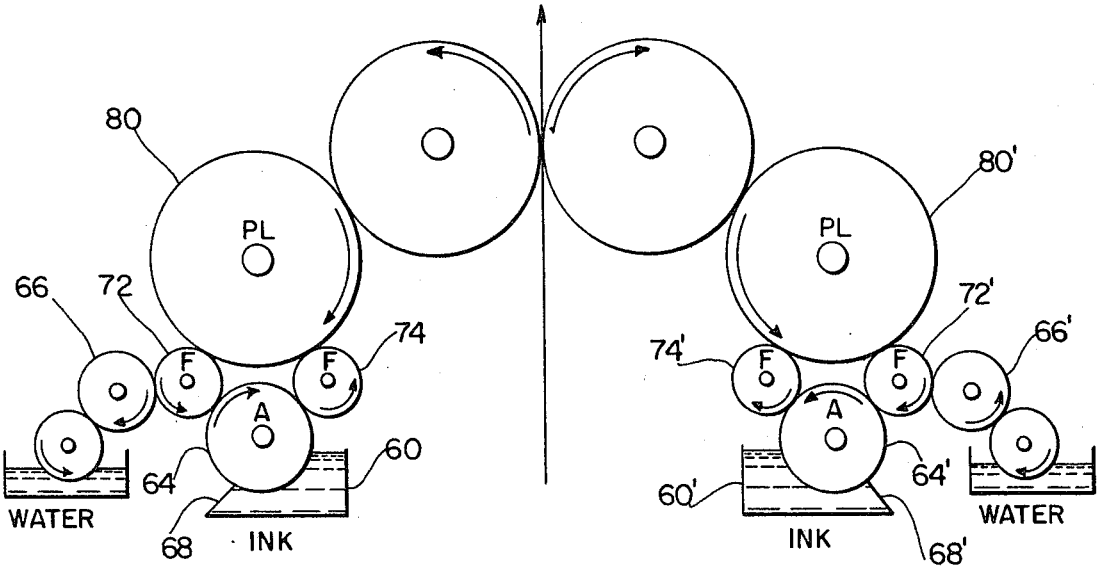
FIG. 8 is a schematic of an offset inking system, modified or "retrofited" according to FIG. 4.

According to the present invention, the engraved surface inking or Anilox cylinders have a plurality of ink repository cells of the type illustrated in FIG. 5. As the ink-filled cells are rotated towards the form rollers, the reverse angle doctor blade scrapes all ink from the top surface diameter of the engraved cylinder, regardless of ink viscosity. Thus, the engraved inking cylinder contains a given quantity of ink which is a function of ink viscosity and the repository cell configuration. This given quantity of ink is thus applied to the pair of form rollers. The engraved cylinder, after contacting and inking the pairs of form rollers, then recontacts the ink within the ink reservoir, effectively cleansing the inking cylinder surface. A new layer of ink is then re-deposited within the ink repository cells, which are scraped by the reverse angle doctor blade.

This is an "on demand inking system", the ink being provided uniformly across the press for transferral only to the contacting segments of the plate. There are no adjustments to be made. The ink density level on the finished web product 24 is a function of ink type, as well as engraved roller repository cell configuration. Once these parameters are determined, there is no need to adjust the ink settings on the press.

The present system for metering ink to the relief plate also has application to planographic lithographic plates. For lithographic plates, both dampener solution (chemically treated water), and oil-based ink are required. The Anilox cylinder, with fountain and doctor blades, can be applied to metering both the ink and the water. Perhaps, the pattern or cell spacing on the water Anilox would differ from the ink Anilox because of the plate water requirement and the different viscous nature of the fluids. However, once the requirement is determined, it should then be an invariant for similar plates, since the Anilox doctor blade characteristically meters a uniform film of water on the surface of the Anilox roller. Since both the plate and the Anilox are hard surfaces, a pair of elastomer form rollers is required between the two to ameliorate surface irregularities.

With this system, both ink and water settings would not be required. The amount of ink and water transferred to the plate will be a function of the plate content, i.e., black areas will take ink and white areas will take water. Only the amount removed will be replenished by the Anilox.

In addition to the elimination of ink and water settings, this system has the added virtue of simplicity, low cost and low maintenance. The multiplicity of rollers, including oscillators, normally encountered in lithographic presses, is eliminated.

Figure 3:
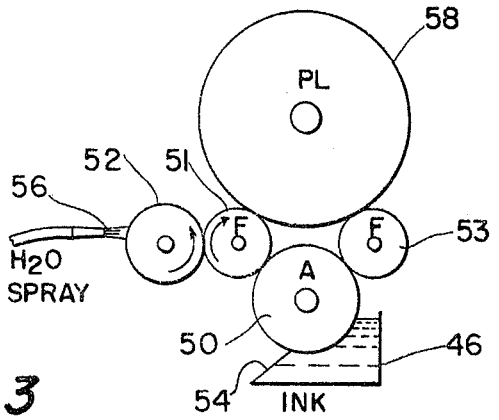
FIG. 3 is a schematic of an offset inking system according to the present invention, wherein the inking cylinder contacts a pair of form rollers, with a water spray of the Smith dampener and water roller contacting one of the form rollers.

In FIG. 3 there is illustrated another mode of invention wherein engraved or Anilox roller 50 is rotatably mounted within ink reservoir 46, so as to be scraped by reverse angle doctor blade 54 prior to contact of the pair of form rollers 51, 53 which, in turn, contact plate cylinder 58. A water roller 52, contacting form roller 51, may be employed together with a "Smith" water spray dampener device 56.

Figure 4:
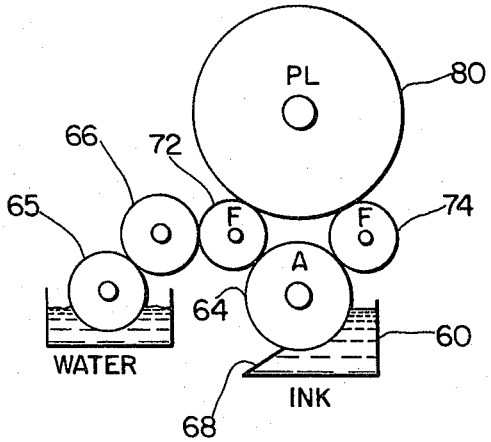
FIG. 4 is a schematic of an offset inking system according to the present invention, wherein the Anilox inking cylinder contacts two form rollers, one of which is contacted by a "Dahlgren" dampener roller.

In FIG. 4 a further modification is illustrated wherein engraved or Anilox inking cylinder 64 is rotatably mounted within ink reservoir 60, so as to be scraped by reverse angle doctor blade 68. Inking cylinder 64, after being scraped clean by doctor blade 68, contacts a pair of form rollers 72 and 74 which, in turn, contact plate cylinder 80. Form roller 72 may be contacted by a conventional Dahlgren dampener device 66.

OPERATING CHARACTERISTICS

FIG. 2 - Anilox Dampening System

The pattern or configuration of the cell structure determining the amount of dampening solution (water) applied to the printing plates. For a given Anilox roller 27, the water film thickness and, hence, amount of water applied to the plate, remains fixed. As the water film thickness is controlled and kept fixed at all press speeds by Anilox roller 27, the starvation or buildup on the water form roller 32, or on the plate 44, is eliminated. This, in turn, makes the dampening system automatic, as it does not require any adjustment to overcome starvation or flooding of water on the plate. This is the main advantage of this type of dampening system. Other advantages are less start-up waste and quick start-up time, as the ink water balance is preset by selection of the Anilox rollers. Quick start-up increases production and reduces total production time for a given number of copies to be printed.

In a suggested configuration, the Anilox roller 27 will be "250 lines ANPA special", the reverse angle doctor blade 29 will be 0.008 thick stainless steel, and water from form roller 32 will be a "Neoprene" type roller with durometer hardness of 20–25 Shore A. The contact pressure between two rollers is measured in terms of stripe width. It is a width of the contact area under pressure at the nip. The water form roller (32) will be set so as to make a 5/16" stripe with plate cylinder (44) and about ⅜" stripe with Anilox roller 27.

FIG. 3 - Spray Dampening System

FIG. 3 illustrates the use of a commercially available dampening system supplied by Smith RPM Corp., Overland Park, KS and Ryco Graphic Manufacturing, Inc., Wheeling, IL. Fine droplets of water are sprayed on water form roller 52 through a series of nozzles 56, located across the length of form roller 52. As there is no direct or physical contact between the nozzles and the ink form roller surface (as in the case of the Dahlgren dampener), ink particles cannot back-feed to nozzle 56 or the water fountain tray and contaminate the dampening system. Such feedback of ink conventionally hampers the effectiveness of a dampening system and, hence, the printing. The main advantage of the spray dampening system is no ink feedback to the fountain tray and, hence, a cleaner system requiring less maintenance. The system, also, requires less energy to operate, compared to the direct contact type and is relatively less costly. The main disadvantage is slightly lower print quality, as it is hard to control spray nozzle 56 to accurately apply the required amount of water to the plate. Sometimes water droplets are not converted to the film on form roller 52, resulting in water marks on the print.

The spray dampening system consists of an oscillating nozzle bar with an array of nozzles 56 about 2 ½' apart, a transfer roller 52, conventional metering water pumps, air blowers and controls (not illustrated). Compressed air and water are combined with nozzles which, in turn, spray air and water upon transfer roller 52. The entire nozzle bar is oscillated back and forth by an electric motor to achieve an even supply of water across the web. The water is supplied by a metering pump which is adjustable. Air is supplied by an air blower. Nozzles 52 are kept about 1" away from transfer roller 52. The nip pressure between the transfer roller 52 and ink form roller 51 is about ⅜". The nip pressure between ink form rollers 51 and 53 and plate cylinder 58 is about 5/16". The metering pumps are set at 50% of the volume. These pumps are fine tuned, depending on the page make-up.

FIG. 4 - Dahlgren Dampening System

This is a commercially available dampeneing system supplied by Dahlgren Manufacturing Co., Dallas TX. A film of water is applied to water form roller 66 by a doctor roller (not illustrated). This doctor roller has better control over the water film thickness and, hence, the amount of water applied to plate 80. This results in better print quality and no water marks on the copy.

The suggested Dahlgren Dampening System consists of two rollers -- a conventional metering roller positioned in a water pan and a transfer roller 66 contacting the metering roller. The transfer roller is a chrome plate steel roller which contacts the ink form roller to transfer the film of water to the plate. The amount of water transferred to plate cylinder 80 is controlled by varying the speed of the metering roller and by adjusting the nip pressure between the metering roller and transfer roller 66. Here again, the roller settings are similar to the other systems. The nip pressure between the form roller 72 and plate cylinder 80 is about 5/16" stripe, and that between the form roller 72 and the Anilox roller 64 is ⅜" stripe. The stripe setting between the transfer roller 66 and the form roller 72 is ⅜" stripe, and that between the transfer roller 66 and the metering roller is also ⅜". The speed of the metering roller is set at the 60% level.

Manifestly, the reservoir and repository cell configurations may be varied without departing from the spirit of invention.

Preferred press operating parameters include:

A. Anilox Inking and Watering Rollers

Applicants have successfully used engraved Anilox rollers with screen size ranging from 200 to 360 cells per linear inch. The amount of ink or water transfer is a function of both the cell opening area and the depth of the cell. The fluid removed from the cell depends on the viscosity, volume carrying capacity of the engraving, and the contacting pair of form rollers. The required cell configuration for a specified ink transfer/print density is determined experimentally for a given composition and viscosity of the ink.

A typical Anilox inking roller, as illustrated in FIG. 5, was engraved with truncated pyramid cell structure with 250 cells per linear inch screen size. The cell dimensions at the top were: 70 micron square opening, 30 micron wall thickness, and 18 micron cell depth; and the volume carrying capacity was 2.728 cubic mm. The surface of the Anilox roller was coated with Tungsten carbide to give better wearability and an oleophilic surface characteristic.

A typical Anilox water roller used was also engraved with a truncated pyramid cell structure with 250 cells per linear inch screen size. The cell dimensions at the top were: 75 micron square opening, 25 micron wall thickness, and 20 micron cell depth. The volume carrying capacity was 3.385 cubic mm. The surface of the Anilox was covered with hard chrome to give better wearing surface and an hydrophilic surface characteristic.

B. Ink Composition:

Applicants have successfully used both a typical offset ink and the letterpress news ink in this inking system. A typical offset ink contains 12–30% carbon black or color pigments suspended in the petroleum oil. It also contains hydrocarbon resin and aliphatic solvent. The viscosity of the ink is about 500 poise. The letterpress news ink, used in the system, is thinner than the offset ink with the viscosity range of 30–90 poise. It contains 9–14% carbon black or color pigments suspended in petroleum oil. These typical examples are not all inclusive - other variations can possibly be used.

C. Dampening Solution

Applicants have printed, using many commercially available dampening solutions, both alkaline and acidic types, with a pH range of 3–12. A typical dampening solution will be an alkaline water with pH value between 10 and 11.

D. Ink and Water Form Rollers

The Anilox inking system is compatible with all types of commercially available form rollers as trademarked "Buna-N" and "Neoprene", as well as "Polyurethane and polyvinyl chloride". Typical form rollers we used are composed of "Neoprene" with durometer hardness of about 40 Shore A.

These pairs of form rollers are set with a stripe width of about 5/16" with both the Anilox roller and the plate.

A typical watering single form roller used is composed of "Neoprene" with durometer hardness of between 20–25 Shore A. This form roller is also set with the strip width of 5/16".

E. Settings and Speed

The setting for contact pressure between plate and blanket is typically 0.004" and the setting for printing pressure at the printing nip is typically 0.007", including the thickness of the paper.

The Anilox inking system is compatible with press speeds ranging from jogging (substantially zero) to the present top newspaper press speed of 80,000 impressions per hour. This translates web speeds as great as 2,500 lineal feet per minute.

F. Substrate

The type of substrate used is a newsprint with nominal weight of 30 lb. per ream and thickness of 0.003".

We claim:

1. Method of enhancing high viscosity inking in a rotary newspaper web offset printing press system of the type applying high viscosity ink to both sides of the web; providing a press system with dual printing units, one on each side of the web, each printing unit including a blanket cylinder, a plate cylinder contacting said blanket cylinder, and an inking and dampener component contacting said plate cylinder, each component having an ink reservoir with an inking cylinder rotatably positioned therein, a pair of form rollers rotatably contacting said inking cylinder and a water reservoir with a watering cylinder rotating positioned therein so as to contact one of said form rollers; said plate cylinder independently contacting said pair of form rollers;

A. Defining a plurality of repository cells each conformed as a truncated pyramid within the surface of each inking cylinder and each watering cylinder, such that there are 200–360 cells per linear inch;

B. Immersing said inking cylinder repository cells by rotating each said inking cylinder within its ink reservoir where the ink has a hydrocarbon base and a viscosity in the range 3,500–5,000 centipoises and immersing said watering cylinder in said water reservoir by means of a spray dampener;

C. Reverse angle scraping of excess ink from the surface of each said inking cylinder;

D. Further rotating said inking cylinder and inking cylinder repository cells against the surfaces of said pair of form rollers and rotating said watering cylinder against one of pair of form rollers;

E. Rotating each said form roller against the surface of said plate cylinder, printing by rotating said blanket cylinders against opposite sides of a newspaper web moving therebetween such that the speed of rotating said inking cylinder, plate cylinder and blanket cylinder is at speed of printing up to 2,500 lineal feet per minute;

F. Sequentially immersing each inking cylinder and watering cylinder within said reservoirs.

* * * * *

Disclaimer 4,407,196.—*Harshad D. Matalia,* Easton, Pa., and *Menashe Navi,* New York, N.Y. METHOD OF ENHANCING INKING IN OFFSET PRESSES. Patent dated Oct. 4, 1983. Disclaimer filed July 21, 1983, by the assignee, *American Newspaper Publishers Association.*

The term of this patent subsequent to Feb. 15, 2000, has been disclaimed.

[*Official Gazette January 24, 1984.*]